US006866230B2

(12) United States Patent
Kucmerowski

(10) Patent No.: US 6,866,230 B2
(45) Date of Patent: Mar. 15, 2005

(54) APPARATUS FOR AND METHOD OF FLYING TWO-LINE STEERABLE KITES

(76) Inventor: Dennis Lee Kucmerowski, 2075 NW. 18th St., Delray Beach, FL (US) 33445

( * ) Notice: Subject to any disclaimer, the term of this patent is extended or adjusted under 35 U.S.C. 154(b) by 0 days.

(21) Appl. No.: 10/454,268

(22) Filed: Jun. 4, 2003

(65) Prior Publication Data

US 2004/0245401 A1 Dec. 9, 2004

(51) Int. Cl.[7] ..... B64C 31/06
(52) U.S. Cl. ..... 244/155 A; 244/155 R
(58) Field of Search ..... 244/153 R, 155 A, 244/154, 115, 116, 33; 116/39.16, 39.21; 446/31, 32, 33

(56) References Cited

U.S. PATENT DOCUMENTS

| | | | | | |
|---|---|---|---|---|---|
| 2,388,478 | A | * | 11/1945 | Garber | 244/155 A |
| 2,559,049 | A | * | 7/1951 | St Clair | 446/31 |
| 2,975,549 | A | * | 3/1961 | Larsen | 446/32 |
| 3,358,399 | A | * | 12/1967 | Waldmann | 43/4 |
| 3,448,864 | A | * | 6/1969 | Fenn et al. | 212/71 |
| 3,593,940 | A | * | 7/1971 | Stanton | 242/390.8 |
| 3,740,010 | A | * | 6/1973 | Curtis | 244/155 A |
| 3,807,672 | A | * | 4/1974 | Williams | 244/155 A |
| 3,987,987 | A | * | 10/1976 | Payne et al. | 244/153 R |
| 4,893,435 | A | * | 1/1990 | Shalit | 49/360 |
| 5,030,156 | A | * | 7/1991 | Savicki, Sr. | 446/32 |
| 5,816,877 | A | * | 10/1998 | Chuang | 446/31 |
| 6,398,147 | B1 | | 6/2002 | Fredrickson | |
| 6,514,115 | B2 | | 2/2003 | Harich | |
| 6,581,879 | B2 | | 6/2003 | Bellacera | |

FOREIGN PATENT DOCUMENTS

| | | | | |
|---|---|---|---|---|
| DE | 320411 | * | 4/1920 | 244/153 R |

* cited by examiner

*Primary Examiner*—Tien Dinh
(74) *Attorney, Agent, or Firm*—Frank J. Benasutti

(57) ABSTRACT

A flying device and control mechanism provides the capability for controlling two-line steerable kites by removing the need for physical strength to control the two-line steerable kite; providing the capability to adjust the flying lines to control the kite; and providing the capability to follow the flight of the kite, left, right, up, and down to control the kite.

8 Claims, 4 Drawing Sheets

APPARATUS FOR AND METHOD OF FLYING TWO-LINE STEERABLE KITES

BACKGROUND OF THE INVENTION

1. Technical Field

The present invention is related to flying two-line steerable kites and, in particular, to an apparatus and method for controlling a two-line steerable kite.

2. Description of the Prior Art

A person usually controls two-line steerable kites. Two flying lines of equal length are attached to the kite. While holding one line in each hand, the person controls the kite by hand/arm movement to change the physical orientation of the surface of the kite to the wind. While one hand is pushed away from the body, the other is pulled near to the body. Pulling the right hand towards the body and pushing the left hand away from the body allows the kite to fly loops to the right. Pulling the left hand towards the body and pushing the right hand away from the body allows the kite to fly loops to the left. Evening out the distance of both hands will allow the kite to fly in the direction of the leading edge of the kite. In turn, the dynamics of the kite surface with the wind allows the kite to move through the air and be guided by the person. The kite can be controlled to fly in any direction, up, down, left, right, loop and dive. Not only is the movement of the hands and arms important, it is as important for the person controlling the kite to turn their body left and right in order to face the kite at all times. Facing the kite at all times gives the kite flyer maximum control when controlling the kite. As the kite flies left, the person controlling the kite should turn left. As the kite flies right, the person controlling the kite should turn right; always facing the kite.

Dependant upon the physical disability of a person, some people cannot experience the joy of flying two-line steerable kites. Some kites have a great deal of pull. Some people may not have the physical strength to handle and control these kites. Other people my only have limited physical mobility in their hands, feet, head or eyes. This too may not allow the person to control the kite. Thus, physical control of a two-line steerable kite may not possible due to a person's physical disability.

It is therefore an object of the present invention to provide a device and control mechanism that can provide the capability for controlling two-line steerable kites.

DISCLOSURE OF THE INVENTION

Summary of the Invention

In accordance with my invention, I achieve the above object by (a) removing the need for physical strength to control the two-line steerable kite; (b) providing the capability to adjust the flying lines to control the kite; and (c) providing the capability to follow the flight of the kite, left, right, up, and down in order to control the kite.

In addition, control means (mechanisms) are provided to the control the device that flies the two-line steerable kite.

The capabilities provided according to the present invention allow a person to fly a two-line steerable kite without the need of physical strength. This is achieved by means of a flying device means that flies the two-line steerable kite and a control mechanism means used to control said device. Thus, the present invention provides the capability to control the flying lines, to follow the kite in flight and to remove the need for physical strength.

I have invented an apparatus that provides the capability for flying a steerable kite having two flying lines, comprising:

a flying device means attached to the flying lines for providing the capability to follow the flight of the kite, left, right, up, and down by adjusting the length of the lines relative to one another; and a control mechanism means co-acting with said flying device means for controlling the adjusting of the lines.

I have also invented a method that provides the capability for flying a steerable kite having two flying lines, comprising the steps of:

a. attaching to the flying lines of the kite a flying device providing the capability to follow the flight of the kite, left, right, up, and down by adjusting the length of the lines relative to one another; and b. controlling said flying device to control the adjusting of the lines.

DESCRIPTION OF THE PREFERRED EMBODIMENT

Figure 1:
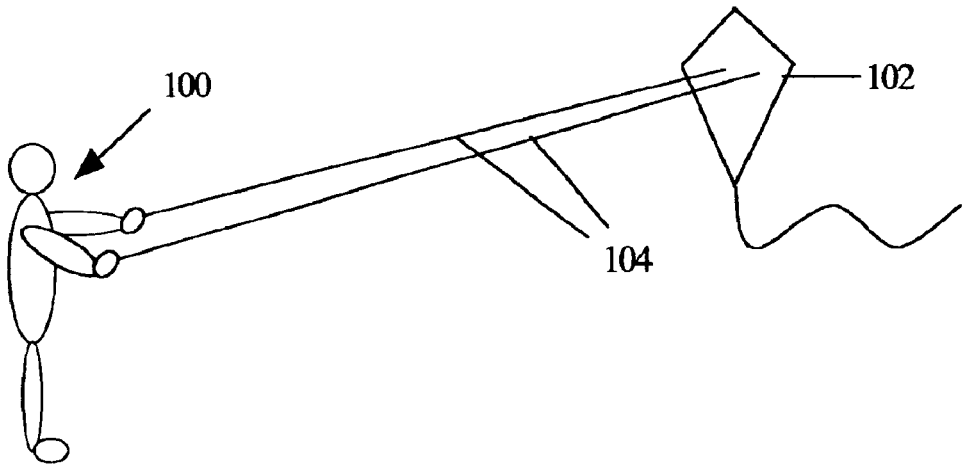
FIG. 1 shows diagrammatically a person flying a two-line steerable kite.

FIG. 1 illustrates a person, designated generally 100, physically flying a two line steerable kite 102 having two flying lines 104 attached to the kite to control the flight of the kite.

Figure 2:
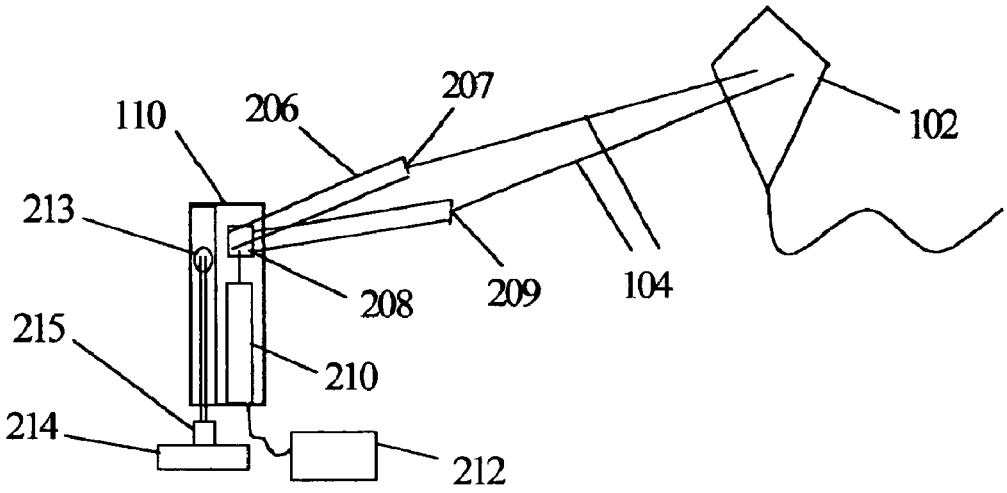
FIG. 2 shows schematically a device for flying a kite according to the present invention.
Figure 6:
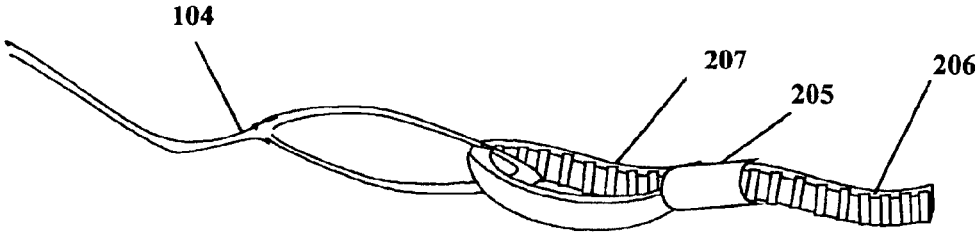
FIG. 6 is a perspective view of a portion of the apparatus joined to the line of a kite.

Referring to FIG. 2, a flying device means 110 in accordance with my invention is shown providing the capability to adjust the flying lines 104 to control the kite 102, by means of a reversible motor, shown schematically at 210 coupled with timing gear, shown schematically at 208 and an open-ended timing belt 206. Each end 207,209 of the timing belt 206 is attached to one of the flying lines 104. For example, as shown in more detail in FIG. 6, the timing belt can be doubled back against itself and secured as, for example, by tape at 205. The end of the timing belt can be passed through a loop in the kite line 104.

Figure 3A:
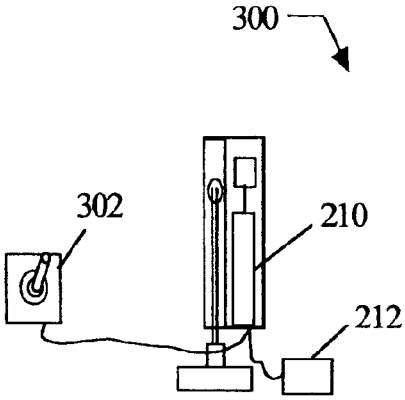
FIGS. 3A and 3B show various mechanisms to control the device.
Figure 3B:
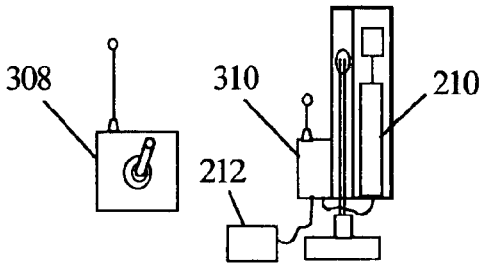

The motor 210, FIGS. 2, 4, 5, 7 and 8, has a power source 212 that can be controlled and operated in a forward and reverse direction by a control mechanism, FIG. 3A or FIG. 3B, to control the flying lines.

FIG. 2 shows schematically an arrangement capable of performing the control for adjusting the flying lines to control the flight of the kite according to my invention; for example, by means of swivel mechanisms 213 for vertical movement and 215 for horizontal movement, attached to a base 214. The base is, preferably, anchored to the ground. The swivel mechanisms 213, 215, FIGS. 7 and 8, provide the capability to follow the flight of the kite, left, right, up, and down.

Figure 7:
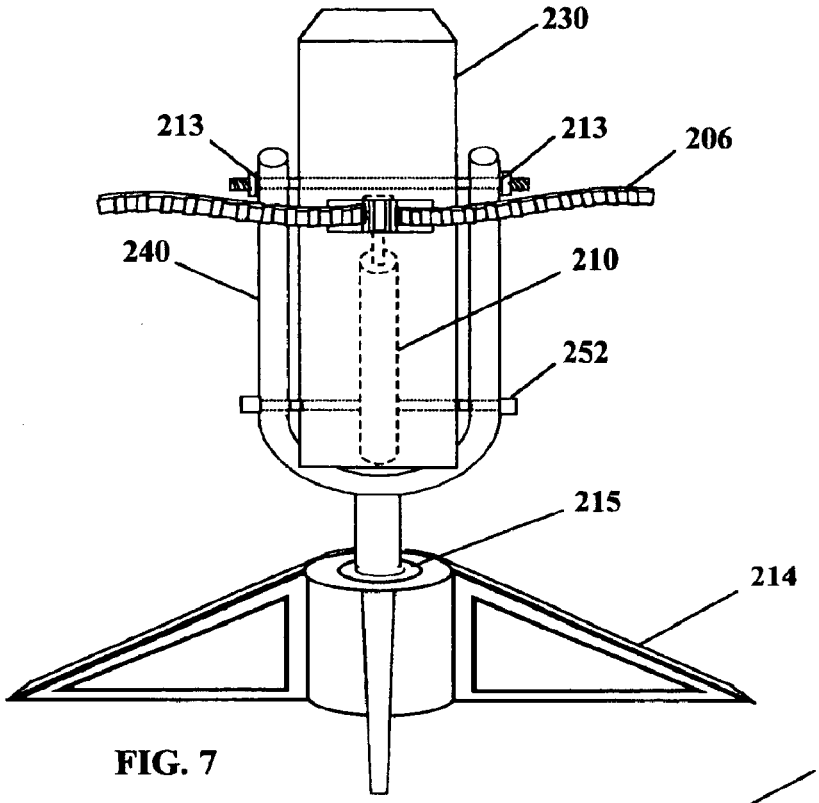
FIG. 7 is a perspective view of a portion of the device which is connected to a line.

The motor 210 can conveniently be mounted within an enclosure 230 by any suitable means as shown in FIG. 7. The shaft 232 of the motor 210 is connected to the timing gear 208. Since the motor is reversible, so is the gear. To keep the gear in operative connection to the timing belt 206, pinch rollers 211 are provided. The pinch rollers are pressed against the timing belt and held against the timing belt by means of a suitable tension device 245 as shown schematically in FIG. 5.

Figure 8:
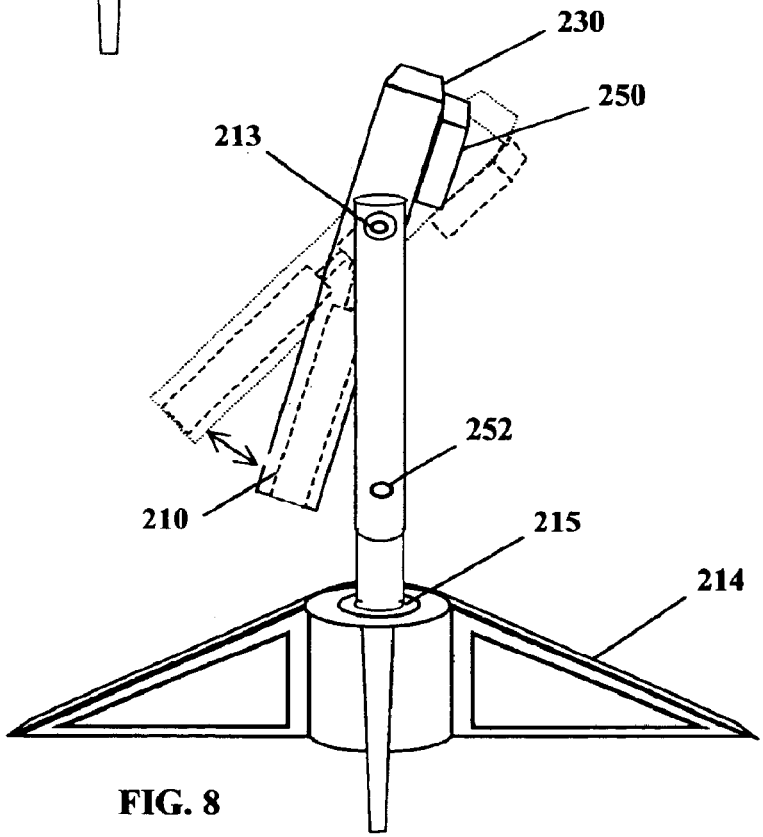
FIG. 8 is another perspective of a portion of the device.

The housing 230 is free to rotate about the pivot rod 213 upon which it is mounted, FIGS. 7 and 8. The yoke 240, which holds this rod 213, is mounted in the base 214 and is free to rotate about the swivel 215.

Since the motor is relatively heavy, the device needs a counterbalance as shown at 250, FIG. 8.

A flexible strap 252 is retained across the yoke so that the housing 230 can rest against its lowest most point and absorbs the shock of the housing hitting the strap from time to time during operation.

The flying device means 110, FIG. 2, provides the capability of removing the need for physical strength to control the two-line steerable kite and to adjust the flying lines to control the kite, and provides the capability to follow the flight of the kite, left, right, up, and down to control the kite. When the two ends of the timing belt are connected to the lines of the kite and the kite is made to be airborne either by launching by another person or by positioning it in the wind so it launches itself, and there is tension in the lines and timing belt, then the kite will fly and the device will track that flight.

In order to control the flight of the kite, it is necessary to adjust the angle of the kite to the wind by retracting one of the lines 104 and letting out the other line 104, that is, by adjusting the length of the lines relative to one another. In the present invention, a controller mechanism means is used. That mechanism means uses a controller designated generally 300 (FIG. 3A or FIG. 3B) for controlling the flying device means, for example, by means of a toggle switch (FIG. 3A-302) connected to the reversible motor 210 and power source 212. The toggle switch allows easy control of the forward and reverse directions of the motor. This in turn allows a person to control the flight of a two-line steerable kite, by controlling the length of the lines relative to one another.

Other means can also be used to control the motor of the flying device means, for example, a radio controlled transmitter (FIG. 3B-308) and a receiver means 310 having a battery and connected to and including a servo which is in turn connected to a switch and power source 212 to control the motor (FIG. 3B-210) of the flying device means.

Control of the flying device can be adjusted for a person and their physical disability. For example, but not limited to, control by hand, control by foot, control by head movement, control by eye movement.

Figure 4:
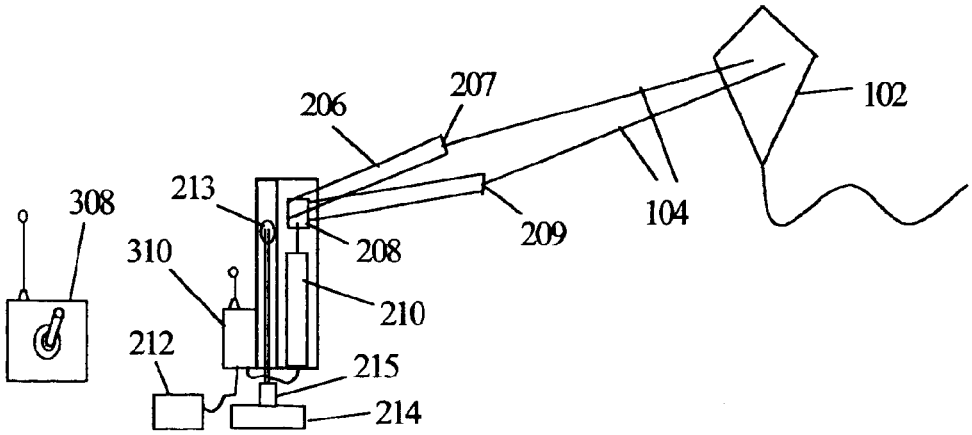
FIG. 4 shows schematically a complete apparatus in accordance with my invention in use with a kite.
Figure 5:
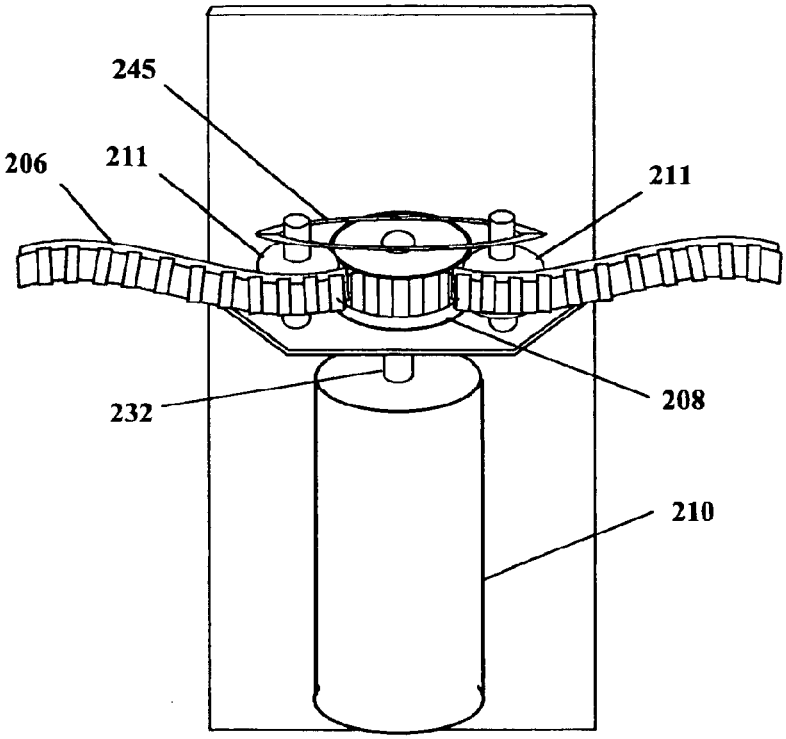
FIG. 5 is a perspective view of a portion of the apparatus.

As can be seem in FIG. 4, the complete apparatus in accordance with my invention consists of two main parts, a flying device means and a controller mechanism means. In combination, these provide the capability to fly a two-line steerable kite without the need for physical strength.

What is claimed is:

1. An apparatus that provides the capability for flying a steerable kite having two flying lines, comprising:

a flying device means attached to the flying lines for providing the capability to follow the flight of the kite, left, right, up, and down by adjusting the length of the lines relative to one another;

a motor engaged with a timing gear to rotate said gear;

a timing belt engaged with the timing gear to move therewith;

said belt having two ends;

each of the ends of the belt being connected to a different flying line; and a control mechanism means co-acting with said flying device means and said motor for controlling the adjusting of the lines.

2. An apparatus that provides the capability for flying a steerable kite having two flying lines, comprising:

a flying device means attached to the flying lines for providing the capability to follow the flight of the kite, left, right, up, and down by adjusting the length of the lines relative to one another;

a motor mounted on a housing so that it swivels both horizontally and vertically;

and a control mechanism means co-acting with said flying device means for controlling the adjusting of the lines.

3. The apparatus of claim 2 wherein the motor is mounted in the housing and the housing is pivotally supported and has attached to it a counterbalance to counterbalance the motor about its pivotal support.

4. The apparatus of claim 2 wherein a shock absorbing means is provided to absorb the shock of the housing.

5. The apparatus of claim 1 wherein the motor is reversible.

6. The apparatus of claim 5 wherein the control mechanism comprises a toggle switch to control the reversible motor.

7. The apparatus of claim 2 wherein the motor is reversible.

8. The apparatus of claim 7 wherein the control mechanism comprises a toggle switch to control the reversible motor.

* * * * *